US005346186A

United States Patent [19]

Given

[11] Patent Number: 5,346,186

[45] Date of Patent: Sep. 13, 1994

[54] NOZZLE GUARD FOR BLAST FURNACE MUDGUN

[75] Inventor: William F. Given, Woodhaven, Mich.

[73] Assignee: Protective Technologies, Inc., Grosse Ile, Mich.

[21] Appl. No.: 72,611

[22] Filed: Jun. 7, 1993

[51] Int. Cl.[5] ..... C21B 7/12

[52] U.S. Cl. ..... 266/270; 266/273

[58] Field of Search ..... 266/273, 272, 271, 268, 266/270

[56] References Cited

U.S. PATENT DOCUMENTS

| | | | |
|---|---|---|---|
| 1,844,194 | 2/1932 | Maltitz | 266/270 |
| 4,135,705 | 1/1979 | Mailliet | 266/273 |
| 5,246,208 | 9/1993 | Mailliet et al. | 266/273 |

FOREIGN PATENT DOCUMENTS

| | | | |
|---|---|---|---|
| 1170555 | 8/1986 | Japan | 266/273 |

*Primary Examiner*—Scott Kastler

*Attorney, Agent, or Firm*—Reising, Ethington, Barnard, Perry & Milton

[57] ABSTRACT

A nozzle guard device (50, 50') has a generally C-shaped half-shell configuration for shielding a lower and otherwise exposed portion of a blast furnace mudgun nozzle (22) from damaging contact with molten metal and slag during taphole closure operations. Mounting elements (86, 86') are provided for extension into an opening (26) of the nozzle (22) for embedding a refractory clay material contained within the opening (26) for securing the nozzle guard device (50, 50') in position on the nozzle (22).

24 Claims, 3 Drawing Sheets

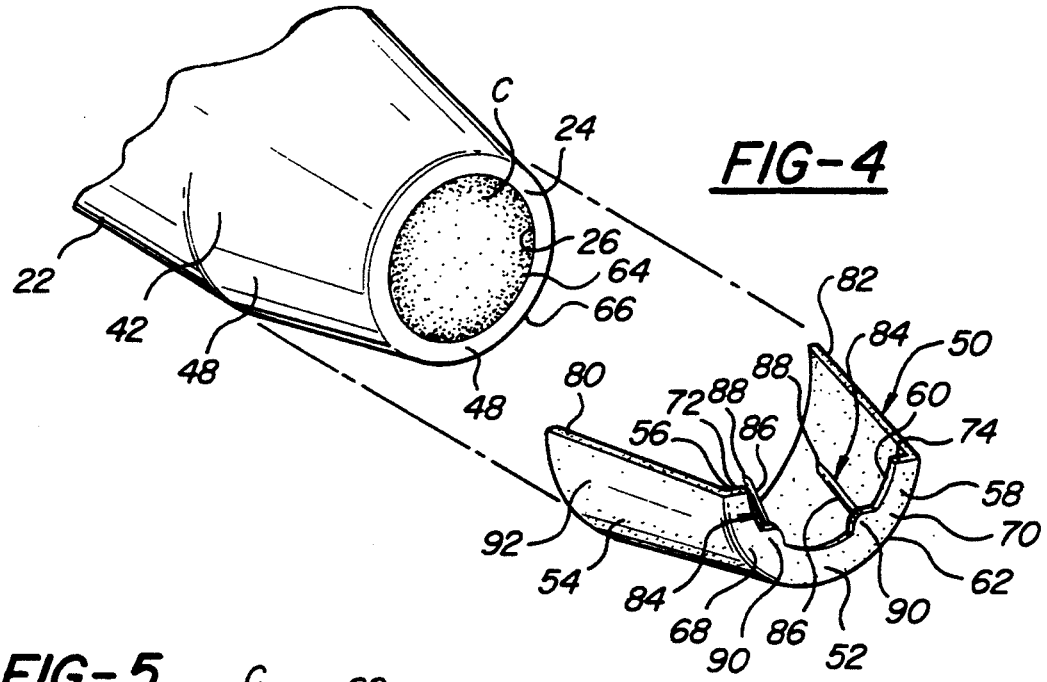
FIG-4
FIG-5
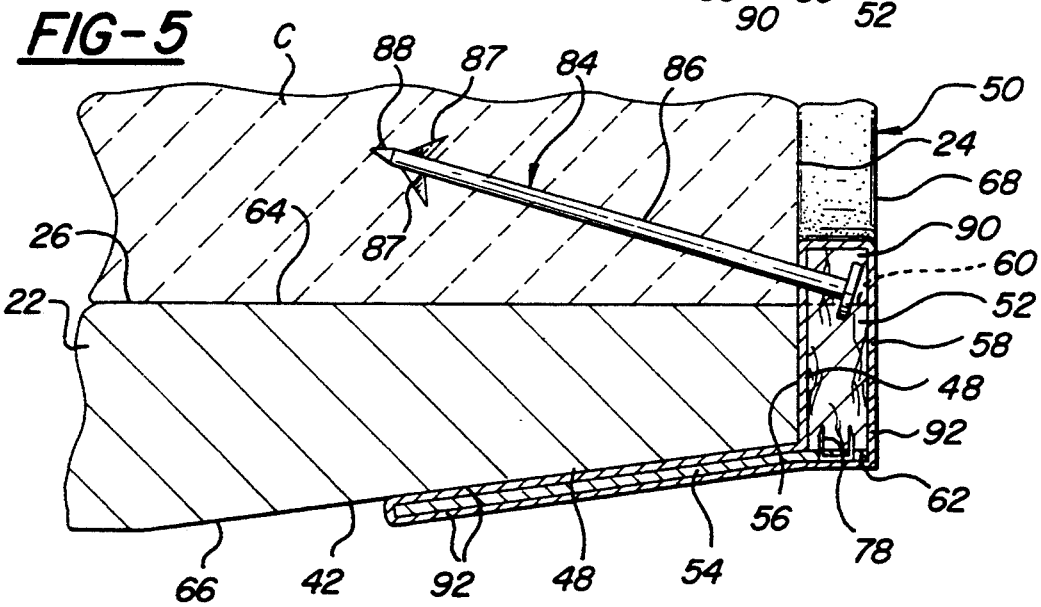
FIG-6
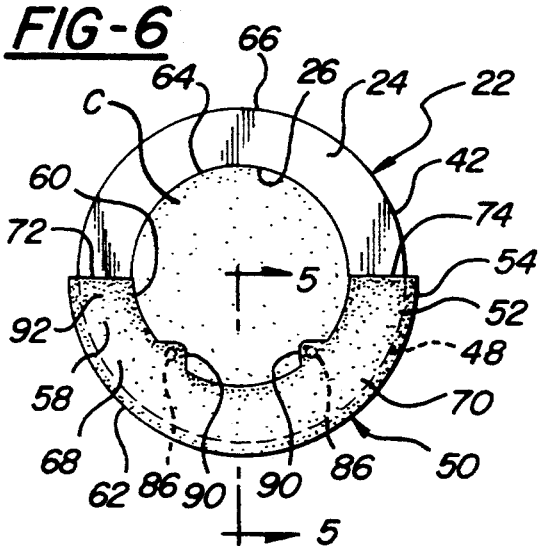
FIG-8
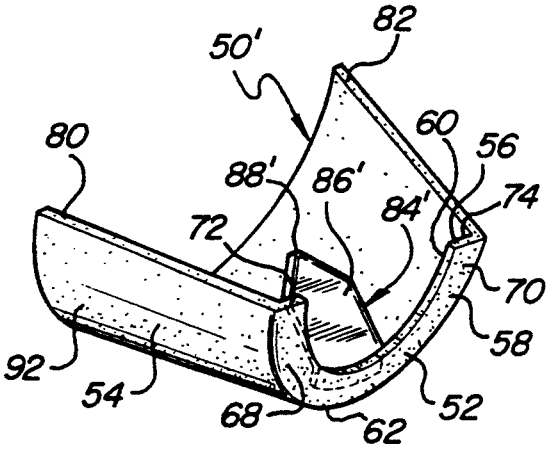

NOZZLE GUARD FOR BLAST FURNACE MUDGUN

TECHNICAL FIELD

This invention relates generally to blast furnace iron making operations and more specifically to the construction of nozzle guard devices used to protect an otherwise exposed portion of a blast furnace mudgun nozzle from contact with molten iron and slag during taphole closing operations.

BACKGROUND ART

Iron is produced by smelting raw iron ore material in a blast furnace. Molted iron collects at the bottom of the furnace and is periodically tapped out of the furnace through a tapping hole. As the furnace nears empty, the tapping hole is closed by a mudgun. The mudgun is advanced toward the taphole and a nozzle of the mudgun inserted into an accommodating taphole socket after which refractory clay material is injected into the taphole through an opening in a front endface of the nozzle. As the nozzle approaches the taphole socket, a lower portion of the nozzle and particularly the lower portion of the endface comes into direct contact with the molten metal and slag exiting the taphole. Over time, the repeated exposure to the molten iron and corrosive slag material erodes the nozzle tip and impairs the ability of the nozzle to properly seal the taphole socket allowing the molten iron, slag, and injected clay material to pass by the nozzle.

In the past, the nozzle was left unprotected and the exposed portion allowed to erode, requiring periodic replacement and repair of damaged nozzles. This practice, however, is costly and labor intensive as it requires a large number of nozzles to be kept on hand and trained personnel who are skilled in replacing nozzles and repairing damaged ones.

Recently, I developed a nozzle guard illustrated in FIG. 1 of the drawings which fits over the nose and endface of the nozzle shielding the otherwise exposed portion of the nozzle from contact with the outflowing molten metal and slag during taphole closure operations. This nozzle guard has an annular ring portion that fits over the endface of the nozzle serving as a face shield and a frusto-conical skirt portion extending around the entire outer perimeter of the ring portion and flaring rearwardly to cover the correspondingly shaped tapered nose of the nozzle protecting it from exposure to the molten metal. The top portion of the skirt has a pair of cutouts that receive a corresponding pair of hillside washers mounted on the nozzle upon sliding the nozzle guard over the nozzle to secure the guard to the nozzle. The ring portion and skirt are fabricated of combustible materials such as wood and pressboard materials and coated with a protective refractory material.

This nozzle guard adequately protects the otherwise exposed portions of the nozzle from erosion by the molten metal and slag. However, it also covers and provides unneeded protection to the top portions of the nozzle that normally are not exposed to the molten metal and slag. The unneeded upper portion of the guard may not completely burn during the taphole closing procedure interfering with the ability of the nozzle to properly seat and seal in the taphole socket.

Modification of the nozzle to include the hillside washers is also necessary to secure the guard on the nozzle.

SUMMARY OF THE INVENTION AND ADVANTAGES

A protective nozzle guard device for attachment to a nozzle of a blast furnace clay gun includes a face guard member extending arcuately between opposite ends in a generally C-shaped configuration. The guard device includes mounting means for mounting and retaining the face guard member on a bottom and otherwise exposed portion of the nozzle endface to shield that portion of the nozzle from contact with the molten metal and slag during taphole closing operations.

According to another aspect of the invention, a protective nozzle guard device for attachment to a nozzle of a blast furnace clay gun includes a face guard member having a back surface for placement against the endface of the nozzle and an opposite front surface, and is provided with mounting means projecting beyond the back surface of the face guard member for insertion into an opening of the endface in which clay material is contained so as to embed the mounting means in the clay and thereby retain the nozzle guard device on the nozzle to shield the endface of the nozzle from exposure to the molten metal and slag during taphole closing operations.

The present nozzle guard device has several advantages over my previous guard device in that it shields only the critical portions of the nozzle that are otherwise exposed to the molten metal and slag with a recognized material and cost savings and provides a means for mounting the guard device on the nozzle without requiring modification of the nozzle. It also omits the unneeded upper portion of the nozzle guard that is susceptible to incomplete burning, hence minimizing the possibility of the nozzle guard inhibiting proper seating of the nozzle.

BRIEF DESCRIPTION OF THE DRAWINGS

These and other features and advantages of the invention will become more readily understood and appreciated by those skilled in the art when considered in connection with the following detailed description and drawings, wherein:

FIG. 4 is a perspective view of a nozzle guard constructed according to a first embodiment of the invention and the mudgun nozzle;

FIG. 5 is a fragmentary side sectional view of the assembled nozzle guard and nozzle taken along lines 5—5 of FIG. 6;

FIG. 6 is a front end view of the assembled nozzle guard and nozzle;

FIG. 8 is a perspective view of a nozzle guard device constructed according to a second embodiment of the invention.

DETAILED DESCRIPTION OF THE EMBODIMENTS

Figure 1:
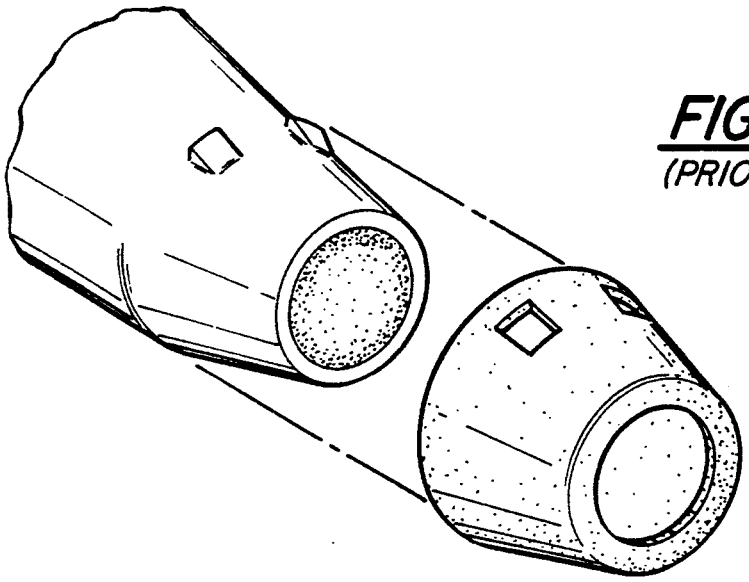
FIG-1 (PRIOR ART)
FIG. 1 is a fragmentary exploded perspective view of a prior art nozzle guard and nozzle assembly.
Figure 2:
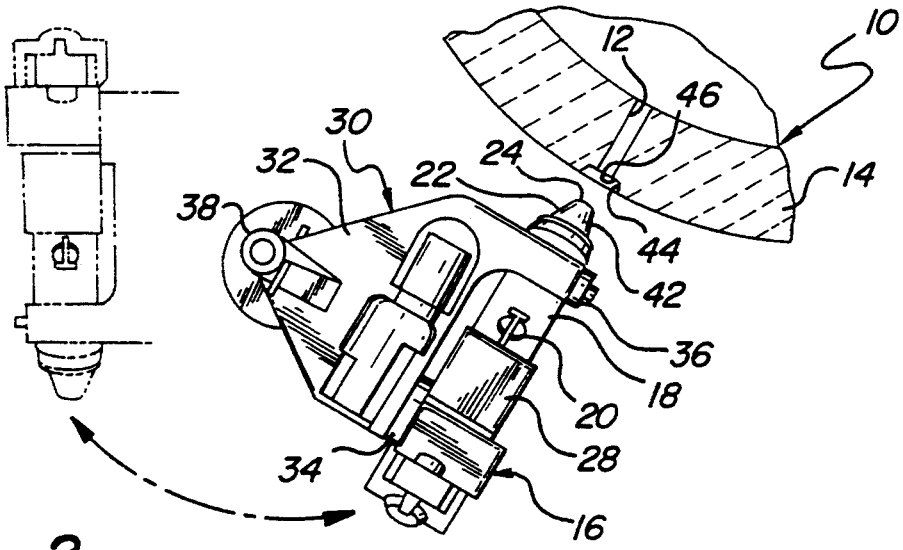
FIG. 2 is a fragmentary plan view shown partly in section of a blast furnace and mudgun.
Figure 3:
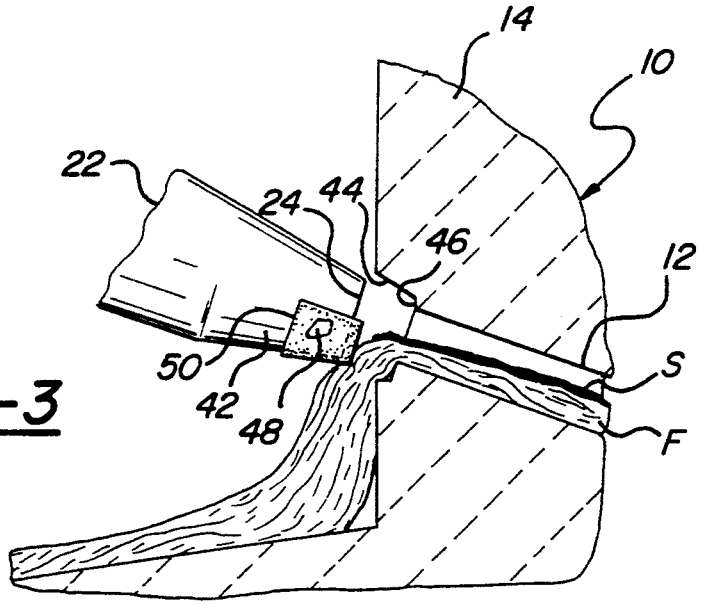
FIG. 3 is a fragmentary side sectional view of the blast furnace showing the lower shielded portion of the nozzle exposed to the outflowing molten metal and slag.
Figure 7:
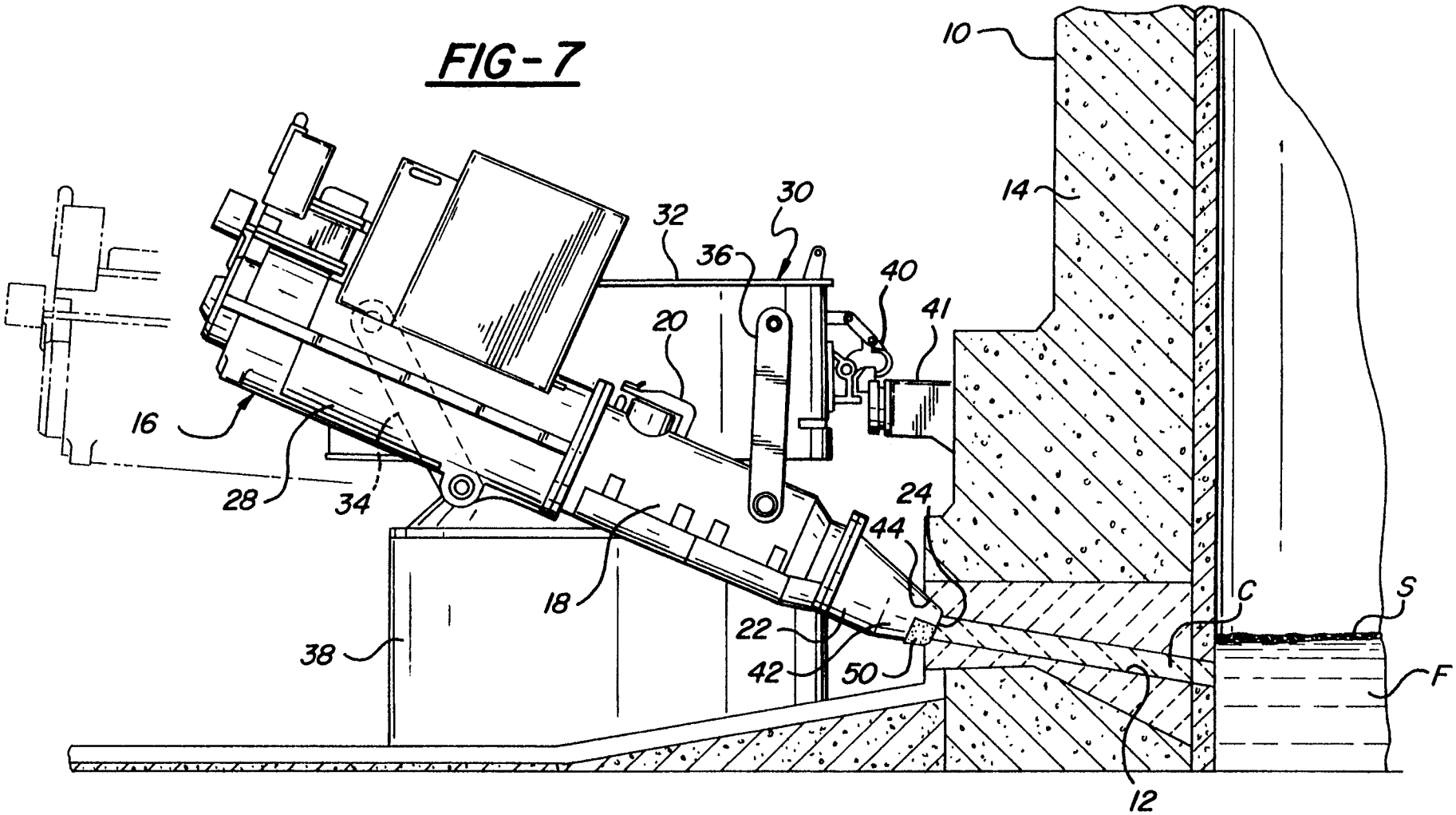
FIG. 7 is a fragmentary sectional view taken along lines 7—7 of FIG. 2.

A blast furnace is indicated generally at 10 in FIGS. 2, 3, and 7 and is used for smelting iron ore to produce molten iron F which collects at the bottom of the furnace and is periodically drained or tapped out of the furnace through a taphole 12 extending through a refractory side wall 14 of the furnace 10 for further treatment. The taphole 12 is normally filled with refractory clay material C introduced into the taphole 12 by a conventional mudgun (also known as a clay gun) 16 to prevent the molten iron F and any slag material S floating atop the iron from exiting the furnace 10 through the taphole 12 during operation of the furnace 10.

The mudgun 16 has a cylindrical main body portion 18 provided with a longitudinally extending internal chamber or passageway (not shown) into which the clay material C is introduced through access opening 20 while in a relatively soft, extrudable state. A nozzle 22 is secured to a front end of the main body portion 18 and extends forwardly therefrom to a distal endface 24. The nozzle 22 is formed with a central passageway or opening 26 that extends through the endface 24 and is in communication with the passageway of the main body portion 18. An extruding device 28 is secured to an opposite rear end of the main body portion 18 and includes a piston (not shown) extendable along the internal passageway of the main body portion 18 for extruding the clay material C out of the gun 16 through nozzle opening 26.

The gun 16 is mounted on a conventional movable support system 30 that enables the gun 16 to be moved out of the way when not in use and brought into engagement with the blast furnace 10 when needed to close taphole 12. The gun support system 30 includes a carriage frame 32 supporting the gun 16 by pivot links 34 and 36 and mounted for rotation about a generally vertical axis of a stationary pedestal 38.

During iron making, the gun 16 is maintained in an inoperative position spaced from the furnace 10 as illustrated by phantom lines in FIG. 2. After a specified quantity of molten iron F has been produced, the taphole 12 is drilled and the molten iron F allowed to drain out of the furnace 10 by gravity through taphole 12. When the furnace 10 nears empty or when it otherwise becomes necessary to close the taphole 12 to stop the outflow of molten iron, the support system 30 is activated to first rotate the gun 16 from the initial inoperative position to an intermediate ready position, shown in solid lines in FIG. 2 and phantom lines in FIG. 7, at which point the nozzle 22 is supported above and outward of the taphole 12. A latching device 40 is actuated and engages a post 41 anchored to the wall 14 of the furnace 10 to lock the carriage frame 32 to the furnace 10 and prevent relative movement therebetween.

The nozzle 22 is swung forwardly and downwardly by controlled activation of pivot links 34 and 36 to insert a tapered frusto-conical nose 42 of the nozzle 22 into a taphole socket or receptacle 44 of the furnace 10 formed at the mouth of the taphole 12. The taphole socket 44 has a shape complimenting that of the nose 42 such that when inserted, the nose 42 fits tightly in the socket 44 and the endface 24 of the nozzle 22 seals against a face 46 of the socket 44 to seal the taphole 12 against molten metal leakage. As the nozzle 22 is inserted into the socket 44, a bottom portion 48 (i.e., the lower frontal region) of the nozzle and particularly the bottom portion of the nozzle endface 24 and underside of the nose 42 passes into the stream of molten metal and slag exiting the taphole 12, as illustrated in FIG. 3. The nozzle 22 is fabricated from cast steel and, over time, repeated exposure to the molten metal stream and slag erodes the bottom portion 46 of the nozzle 22 if left unprotected. Erosion damage to the nozzle 22 is detrimental to the performance of the nozzle 22 as it impairs its ability to seal the taphole 12 against leakage since the eroded regions allow the molten metal to pass by the nozzle 22 and exit the furnace. The remaining upper half portion of the nozzle 22 typically does not come into direct contact with the molten iron stream and hence is not susceptible to erosion.

To prevent nozzle erosion, the present invention provides a protective sacrificial nozzle guard device mounted on the nozzle 22 and covering the critical bottom portion 48 of the nozzle 22 to prevent the outflowing molten metal and slag from contacting and eroding the otherwise exposed bottom portion 48 of the nozzle during taphole closure operations.

A nozzle guard device constructed in accordance with a first embodiment of the invention is shown in FIGS. 3–7 and indicated generally by the reference character 50. The nozzle guard 50 has a generally half-shell shroud construction designed to cover the otherwise exposed lower portion 48 of the nozzle and includes a face guard member 52 for overlying and protecting the critical lower portion of the nozzle endface 24 from molten metal exposure and an optional nose guard skirt 54 for covering and protecting the underside portion of the nozzle nose 42 from contact with the outflowing molten metal during taphole closure operations. The face guard member 52 has an arcuate, generally C-shaped half ring configuration and includes a back nozzle-engaging planar surface 56 for placement against the nozzle endface 24 and opposite the front planar surface 58 for exposure to the outflowing molten metal. Extending between the front 58 and back 56 surfaces are inner 60 and outer 62 radially spaced peripheral surfaces that have a generally semi-circular configuration and are concentric. The width between the peripheral surfaces 60 and 62 is selected to correspond closely to that of the nozzle endface 24. The nozzle endface 24 has a ring-shape with inner and outer concentric peripheries 64, 66 of fixed dimension, with the outer periphery 66 defining the boundary between the nose 42 of the nozzle 22 and the endface 24, and the inner periphery 64 defining the opening 26 through which the clay material C is extruded. The size and shape of the face guard member 52 is selected to correspond closely to that of the lower critical portion of the nozzle endface 24 such that when attached to the nozzle 22, the face guard member 52 covers the lower portion 48 of the endface 24 most prone to molten metal exposure during taphole closing operations and leaves the remaining upper portion of the nozzle endface 24 that is less prone to exposure and hence not in need of protection uncovered.

The front 58, back 56 and inner 60 and outer 62 surfaces of the C-shaped face guard member 52 define a pair of arcuate leg portions 68, 70 that are joined integrally at a midpoint of the face guard member 52 and extend outwardly and upwardly therefrom in a C-shaped configuration and terminate at respective diametrically spaced ends 72 and 74 of the face guard member 52 defining an uppermost extreme or extent of the face guard member 52.

The nose guard skirt 54 has a half frustoconical configuration and extends along the outer peripheral surface 62 of the face guard member 52 between the ends 72, 74 and is secured thereto by staples 78 or other suitable fastening devices. The skirt 54 also extends rearwardly beyond the back surface 56 of the face guard member 52 in an outwardly tapering conical configuration corresponding in size and shape to the critical lower portion of the nose 42 so as to closely overlie and protect the lowermost portion of the nozzle nose 42 that is most susceptible to exposure to the outflowing molten metal during taphole closing operations. The remaining upper portion of the nozzle nose 42 that is substantially less prone to exposure is left unprotected and hence not covered by the nose guard skirt 54. The nose guard skirt 54 likewise includes diametrically spaced ends 80, 82 adjacent the ends 72 and 74 of the face guard member 52 defining an uppermost extent of the nose guard skirt 54.

The nozzle guard device 50 is provided with mounting means 84 for mounting and retaining the nozzle guard 50 on the nozzle 22 with the leg portions 68, 70 curved upwardly as shown in FIGS. 3–7 for covering and protecting the otherwise exposed lower portion 48 of the nozzle 22 from contact with the molten iron F and slag S during taphole closure operations. Although it is contemplated that any of a number of devices could be used to retain the nozzle guard 50 in contact with the lower portion 48 of the nozzle 22, such as straps or other securement devices, the preferred construction of the mounting means 84 comprises one or more spike-like mounting elements 86 that are fixed to the nozzle guard 50 and particularly the face guard member 52 and project rearwardly beyond the back surface 56 of the face member 52 adjacent the inner peripheral surface 60 for extension into the nozzle opening 26, as illustrated best in FIG. 5, so as to become embedded in the clay material C contained within the nozzle opening 26. Once inserted, the embedded mounting spike elements 86 coact with the clay material C to resist removal thereby retaining the nozzle guard 50 securely on the nozzle 22. The spike elements 86 are spaced radially inwardly of the outer peripheral surface 62 and the nose guard skirt 54.

The mounting spike elements 86 may comprise a plurality of slender tines, as shown in FIGS. 4 and 5, such as nails that extend beyond the back surface 56 to a distal pointed end 88 and preferably at an inclined angle relative to the back surface 56 and to one another to offer greater resistance to removal once embedded in the clay C. The length of the tines and their angular orientation are selected in part based on the properties and conditions of the clay material C, with longer spikes and/or spikes at a greater inclined angle needed to sufficiently retain the nozzle guard 50 on the nozzle 22 when the clay material C within the nozzle opening 26 is soft as compared to when the clay material C is relatively more rigid. The tines 86 may be further provided with radial barbs or projections 87 adjacent the ends 88 and/or have a spiraling outer surface configuration to increase the resistance to withdraw once embedded in the clay.

As shown in FIGS. 4–6, the face guard member 52, in the first embodiment, is provided with one or more anchor projections 90 corresponding in number to the number of spike elements 86 and projecting radially inwardly beyond the inner peripheral surface 60 of the face guard member 52 such that when the face guard member 52 is mounted on the nozzle endface 24, the anchor projections 90 extend radially inwardly of the nozzle opening 26. The spike elements 86 are mounted to the anchor projections 90 so as to be supportive at or radially inward of the nozzle opening 26 enabling insertion of the spike elements 86 into the opening 26.

It is important that the nozzle guard not interfere with the nozzle's ability to properly seat and seal in the taphole socket 44. It is thus preferred that the nozzle guard 50 be of a sacrificial construction that provides protection to the lower portion 48 of the nozzle 12 during the time that portion of the nozzle 22 is exposed directly to the stream of outflowing molten iron and slag and then perishes enabling the nozzle endface 24 to seal against the taphole socket face 46. For this purpose, the face guard member 52 and nose guard skirt 54 are fabricated of combustible materials that have a flash point substantially below the molten iron temperature. The nose guard skirt 54 is preferably fabricated from ⅛ medium density fiberboard and the face guard member 52 fabricated of ½ thickness wood or fiber-board. The face guard member 52 and nose guard skirt 54 have an outer coating 92 of brittle, frangible refractory material that prolongs the life of the nozzle guard 22 when exposed to the heat of the molten metal. The refractory coating 92 is applied by dipping the nozzle guard 50 in a liquid solution of the refractory coating material after which the coating 92 is allowed to dry and cure into a hard brittle state. The face guard member 52 and nose guard skirt 54 are burned and reduced to ash when exposed to the molten iron. The ash material does not adhere to the taphole socket 44 nor interfere with the sealing of the nozzle 22. The type and thickness of the materials used for the face guard member 52, nose guard skirt 54, and coating 92 are selected to ensure that the nozzle guard 50 survives long enough to adequately protect the nozzle 22 from exposure to the molten iron while also ensuring that the combustible face guard and nose skirt materials are substantially consumed and reduced to ash in the process so as to not interfere with the sealing of the nozzle 22 in the taphole socket 44.

As the nozzle 22 is inserted and forced into the taphole socket 44, the thin and brittle refractory coating 92 fractures and is also destroyed so as to not interfere with the proper seating of the nozzle 22 in the taphole socket 44. Once inserted, the refractory clay material C is extruded out of the gun 16 through opening 26 and into the taphole 12 to stop the outflow of molten metal and slag from the furnace 10. The nozzle 22 is maintained in the socket 44 for sufficient time to allow the clay material C to cure or harden in the taphole 12 after which the nozzle 22 may be withdrawn.

A second embodiment of a nozzle guard device 50' constructed in accordance with this invention is shown in FIG. 8 and is the same in all respects to the first embodiment except the construction of the mounting means 84'. Like numerals will be used to represent like features between the embodiments and primed numerals used to represent common features but of different construction. The mounting means 84' of the second embodiment of the nozzle guard device 50' comprises one or more blade-like spike elements 86 fabricated of heavy gauge sheet material or other suitable material secured to the face guard member 52 and projecting rearwardly beyond the back surface 56 of the face guard member 52 at or just radially inward of the inner peripheral surface 60. The blade-like spike element 86' also has a pointed end 88' and the element 86' is used in the same manner as the previously described elements 86 for mounting the nozzle guard on the nozzle 22. The end 88' may be bent over to provide a radial projection as previously described. The spike element 86' may extend normal to the back surface 56 or at an angle as with the previous spike elements 86. The anchor projections 90 described in the first embodiment may be omitted.

While the invention has been described in terms of specific preferred embodiments thereof, it is not intended to be limited thereto but rather only to the extent set forth hereafter in the following claims.

I claim:

1. A protective nozzle guard device (50, 50') for attachment to a nozzle (22) of a blast furnace clay gun (16) used for selectively closing a taphole (12) of a blast furnace (10) to stop outflow of molten metal and slag therethrough by inserting a nose (32) of the nozzle (22) into the taphole (12) and injecting clay material (C) into the taphole (12) through a nozzle opening (26) in an endface (24) of the nozzle (22), said nozzle guard device (50, 50') comprising:

a face guard member (52) having a back surface (56) an opposite front surface (58) and an outer peripheral surface (60);

and mounting means (84, 84') projecting beyond said back surface (56) and spaced inwardly from said outer peripheral surface (60) of said face guard member (52) so as to be insertable into the nozzle opening (26) for engaging the clay material contained within the nozzle opening (26) in response to inserting said mounting means (84, 84') into said nozzle opening (26) to thereby mount and retain said face guard member (54) in overlying shielding relation with the end face (24) of the nozzle (22).

2. The nozzle guard device of claim 1 wherein said mounting means (84, 94') comprises at least one mounting spike (86, 86') secured to said face guard member (52) and projecting rearwardly beyond said back surface (56) of said face guard member (52).

3. The nozzle guard device of claim 2 wherein said face guard member (52) has an inner peripheral surface (60) spaced radially inwardly from said outer peripheral surface.

4. The nozzle guard device of claim 2 wherein said nozzle guard device (50, 50') further includes a nose guard skirt (54) secured to and extending along said outer peripheral surface (62) and extending rearwardly beyond said back surface (56) for shielding the nose (42) of the nozzle (22) from exposure to the molten metal and slag during taphole closing operations.

5. The nozzle guard device of claim 4 wherein said face guard member (52) and said noise guard skirt (52) are fabricated of combustible materials.

6. The nozzle guard device of claim 5 wherein said face guard member (52) and said nose guard skirt (52) have a protective outer coating (82) of refractory material.

7. The nozzle guard device of claim 1 wherein said face guard member (52) extends accurately between opposite spaced ends (72, 74) in a generally C-shaped configuration.

8. A protective nozzle guard device (50, 50') for attachment to a nozzle (22) of a blast furnace clay gun (16) used for selectively closing a taphole (12) of a blast furnace (10) to stop outflow of molten metal and slag therethrough by inserting a nose (42) of the nozzle (22) into the taphole (12) and injecting clay material (C) into the taphole (12) through an opening (26) in an endface of the nozzle, said nozzle guard device (50, 50') comprising:

a face guard member (52) extending arcuately between opposite spaced ends (72, 74) in a generally C-shaped configuration;

and including mounting means (84, 84') for self-mounting and retaining said face guard member (52) on a bottom portion of the nozzle (22) with said ends projecting upwardly in response to moving said face guard member (52) toward engagement with the nozzle endface (24) to shield a lower and otherwise exposed portion of the nozzle endface (24) from contact with the molten metal and slag during taphole closing operations.

9. The nozzle guard device of claim 8 wherein said mounting means (50, 50') comprises at least one mounting spike (86, 86') projecting rearwardly beyond a back surface (56) of said face guard member (52) to a distal end (88) for insertion into the nozzle opening (26) of the nozzle (22) and embedding in clay material (C) within the nozzle opening (26) to thereby secure said face guard member (52) to the nozzle (22).

10. The nozzle guard device of claim 9 wherein said face guard member (52) has an outer perimeter surface (62), said mounting spike (86) being disposed radially inwardly of said outer perimeter surface (62).

11. The nozzle guard device of claim 10 further including a nose guard skirt (54) secured to said face guard member (52) and extending between said ends (72, 74) and rearwardly beyond said back surface (56) of said face guard member (52) for shielding an underside and otherwise exposed portion of the nose (42) from exposure to the molten metal and slag during the taphole closing operations.

12. The nozzle guard device of claim 11 wherein said mounting means (84) comprises a plurality of said mounting spikes (86).

13. The nozzle guard device of claim 12 wherein at least some of said mounting spikes (86) are inclined in relation to said back surface (56) of said face guard member (52).

14. The nozzle guard device of claim 11 wherein said mounting spike is spaced radially inward of said nose guard skirt (52).

15. The nozzle guard device of claim 14 wherein said face guard member (52) has an inner perimeter surface (64) and at least one anchor projection (90) extending radially inward beyond said inner peripheral surface (60) anchoring said mounting spike (86) to said face guard member (52).

16. The nozzle guard device of claim 11 wherein said mounting spike (86, 86') includes at least one radial projection (87) adjacent said distal end (88, 88').

17. The nozzle guard device of claim 11 wherein said mounting spike (86) comprises a sheet metal blade.

18. The nozzle guard device of claim 11 wherein said face guard member (52) is fabricated of a sacrificial combustible material.

19. The nozzle guard device of claim 18 wherein said face guard member (52) is fabricated of wood.

20. The nozzle guard device of claim 18 wherein said nose guard skirt (54) is fabricated of a sacrificial combustible material.

21. The nozzle guard device of claim 20 wherein said nose guard skirt (54) is fabricated of fiberboard.

22. The nozzle guard device of claim 20 wherein said face guard member (52) and said nose guard skirt (52)

have a protective outer coating (92) of refractory material.

23. The nozzle guard device of claim 22 wherein said refractory coating material is frangible.

24. A protective nozzle guard device (50, 50') for attachment to a nozzle (22) of a blast furnace clay gun (16) having an endface (24) and a nozzle opening (26), said nozzle guard device comprising:

a face guard member (52) fabricated of combustible material, said face guard member (52) having a front surface (58), an opposite back surface (56), and an outer peripheral surface (62); and at least one self-attaching mounting member (84, 84') projecting from said back surface (56) and spaced inwardly from said outer peripheral surface (62) so as to enable said mounting member (84, 84') to be inserted into the nozzle opening (26) to thereby position and retain said face guard member (52) in overlying shielding relation with the nozzle endface (24).

* * * * *

UNITED STATES PATENT AND TRADEMARK OFFICE

CERTIFICATE OF CORRECTION

PATENT NO. :5,346,186
DATED :Sep. 13, 1994
INVENTOR(S) :William F. Given

It is certified that error appears in the above-identified patent and that said Letters Patent are hereby corrected as shown below:

In Column 7, Line 36, delete "(84, 94')" and insert therefor -- (84, 84')--.

In Column 7, line 52, delete "noise" and insert therefor --nose--.

In Column 7, line 56, delete "(82)" and insert therefor -- (92) --.

UNITED STATES PATENT AND TRADEMARK OFFICE

CERTIFICATE OF CORRECTION

PATENT NO. : 5,346,186

DATED : September 13, 1994

INVENTOR(S) : William F. Given

It is certified that error appears in the above-indentified patent and that said Letters Patent is hereby corrected as shown below:

In column 7, line 59, delete "accurately" and insert therefor --arcuately--.

Signed and Sealed this

Fifteenth Day of August, 1995

Bruce Lehman

*Attest:*

BRUCE LEHMAN

*Attesting Officer*

*Commissioner of Patents and Trademarks*